US011781201B2

(12) United States Patent
Bae et al.

(10) Patent No.: US 11,781,201 B2
(45) Date of Patent: Oct. 10, 2023

(54) ALUMINIUM ALLOY MATERIAL AND METHOD OF MANUFACTURING THE SAME

(71) Applicant: UIF (University Industry Foundation), Yonsei University, Seoul (KR)

(72) Inventors: Donghyun Bae, Seoul (KR); Jonggyu Jeon, Seoul (KR); Sangjun Lee, Gyeonggi-do (KR); Kwangmin Choi, Seoul (KR)

(73) Assignee: UIF (University Industry Foundation), Yonsei University, Seoul (KR)

( * ) Notice: Subject to any disclaimer, the term of this patent is extended or adjusted under 35 U.S.C. 154(b) by 0 days.

(21) Appl. No.: 18/086,540

(22) Filed: Dec. 21, 2022

(65) Prior Publication Data

US 2023/0227946 A1 Jul. 20, 2023

(30) Foreign Application Priority Data

Jan. 14, 2022 (KR) ..... 10-2022-0005717

(51) Int. Cl.

| | |
|---|---|
| ***C22C 21/02*** | (2006.01) |
| ***C21D 8/02*** | (2006.01) |
| ***C22F 1/043*** | (2006.01) |
| ***C22C 1/02*** | (2006.01) |

(52) U.S. Cl.

CPC ..... *C22C 21/02* (2013.01); *C21D 8/0226* (2013.01); *C21D 8/0236* (2013.01); *C22C 1/026* (2013.01); *C22F 1/043* (2013.01)

(58) Field of Classification Search

CPC ..... C22C 21/02; C22C 21/04; C22C 21/06; C22C 21/10; C22C 21/12

See application file for complete search history.

(56) References Cited

U.S. PATENT DOCUMENTS

2010/0226817 A1* 9/2010 Pandey ..... C22C 21/02 419/23

* cited by examiner

*Primary Examiner* — Jessee R Roe

(74) *Attorney, Agent, or Firm* — Foley & Lardner LLP

(57) ABSTRACT

An aluminum alloy material according to an embodiment of the present invention is an aluminum alloy including a grain boundary and a plurality of grains divided by the grain boundary, and having a face-centered cubic crystal structure, and includes a band formed by employing one or more non-metallic elements selected from oxygen (O), carbon (C) and nitrogen (N) in an aluminum matrix. Each of the grains includes a plurality of sub-grains divided by a low-angle grain boundary (LAGB), and a band positioned at the low-angle grain boundary may form a coherent interface with an aluminum matrix. Since a plurality of dislocations already are present in the band, a dislocation cell size is reduced during plastic deformation, which greatly contributes to an improvement in elongation. Such an aluminum alloy material can be subjected to cold rolling at a high reduction rate, and as a result, a plate having significantly improved elongation can be obtained.

10 Claims, 12 Drawing Sheets

ALUMINIUM ALLOY MATERIAL AND METHOD OF MANUFACTURING THE SAME

CROSS-REFERENCE TO RELATED APPLICATION

This application claims the benefit of the priority date of Korean Patent Application No. 10-2022-0005717 filed with the Korean Intellectual Property Office on Jan. 14, 2022, the entire contents of which are incorporated herein by reference.

BACKGROUND

1. Field of the Invention

The present invention relates to an aluminum alloy material having high elongation and strength and a method of manufacturing the same.

2. Discussion of Related Art

In general, aluminum or an alloy thereof is a material having a very wide range of industrial applications because it can be manufactured in various shapes using the light and durable characteristics of aluminum. Aluminum itself has low strength and is easily deformed, but an aluminum alloy has high strength and high reliability to the extent that it can be applied to the fields of automobile or aircraft industries by improving strength by additive elements. In recent years, the aluminum alloys have been expanding their applications to various fields such as construction, chemistry, robots, and electronic products as well as automobiles and aircraft fields due to their excellent mechanical strength and low specific gravity.

However, the aluminum alloys have a problem of poor workability because of low elongation. Even if alloying elements are added to an aluminum-based matrix, elongation may not be improved or may even decrease. In addition, as the number of elements added to the aluminum-based matrix increases, improvement in properties such as strength can be expected to some extent, but the effect of improving elongation may be limited and insufficient.

SUMMARY OF THE INVENTION

The present invention is directed to providing an aluminum alloy material having high elongation and high mechanical strength.

The present invention is also directed to providing a method of preparing the aluminum alloy material.

An aluminum alloy material according to an embodiment of the present invention may include an aluminum alloy matrix formed of an alloy of alloying elements and aluminum, including a high-angle grain boundary (HAGB) and a plurality of grains divided by the high-angle grain boundary, and having a face-centered cubic crystal structure; and a band formed by employing one or more non-metallic elements selected from oxygen (O), carbon (C) and nitrogen (N) in the aluminum alloy matrix.

Since a plurality of dislocations are present in the band, a plastic deformation ability of the material can be improved by performing a role such as a dislocation cell during plastic deformation.

In one example of the present invention, the alloying element may selectively include one or more selected from the group consisting of zinc, magnesium, silicon, iron, and copper. When zinc is included, a zinc content may be, for example, 0.1 wt % or more and 12.0 wt % or less based on the aluminum alloy matrix, and when magnesium is included, a magnesium content may be 0.1 wt % or more and 9.0 wt % or less. In addition, when silicon is included, a silicon content may be 0.1 wt % or more and 13.0 wt % or less, and when copper is included, a copper content may be 0.1 wt % or more and 5.0 wt % or less, but is not limited thereto.

In one embodiment, the alloying element may include one or more selected from the group consisting of scandium (Sc), yttrium (Y), titanium (Ti), zirconium (Zr), vanadium (V), chromium (Cr), manganese (Mn), iron (Fe), nickel (Ni), copper (Cu), silver (Ag), zinc (Zn), tungsten (W), magnesium (Mg), calcium (Ca), strontium (Sr) and beryllium (Be).

In one example of the present invention, each of the grains includes a plurality of sub-grains divided by a low-angle grain boundary (LAGB), and a band disposed at a low-angle grain boundary may form a substantially coherent interface with at least one of adjacent sub-grains.

In one embodiment, the band may have an average width of 5 nm or more and 100 nm or less, and an average length of 1 μm or more and 10 μm or less.

In one example, a lattice constant of the band may be 0.01% to 10% greater than the lattice constant of the aluminum alloy matrix.

In one example of the present invention, the band includes a pre-formed dislocation, and a dislocation cell size of the band may be reduced during plastic deformation. This is due to the fact that the band can perform a role such as a dislocation cell, and can improve a plastic deformation ability of a material.

In one embodiment, the aluminum alloy material may have excellent elongation due to the presence of the band, and through this, cold rolling may be possible.

In addition, during a rolling process of the aluminum alloy material, the band may be maintained inside a processed material and may be dispersed and disposed inside the aluminum alloy material.

The band can serve as an obstacle that hinders or inhibits the movement of dislocations, and as a result, the strength of the aluminum alloy material can be improved.

In one embodiment, an average particle diameter of crystal grains of a casting material of the aluminum alloy material may be 20 μm or more and 800 μm or less.

A method of preparing an aluminum alloy material according to an embodiment of the present invention includes: a first step of preparing an aluminum alloy molten metal; a second step of mixing a non-metal-containing nanopowder in the aluminum alloy molten metal; a third step of removing at least a portion of an undecomposed nanopowder from the aluminum alloy molten metal; and a fourth step of preparing a casting material by solidifying the aluminum alloy molten metal.

In one embodiment, the non-metal containing nanopowder may include one or more selected from the group consisting of zinc oxide (ZnO), titanium oxide ($TiO_2$), copper oxide ($CuO_2$), iron oxide ($Fe_2O_3$), copper nitride (CuN), iron nitride (FeN), zinc nitride (ZnN), titanium nitride (TiN), magnesium nitride (MgN), aluminum oxide ($Al_2O_3$), aluminum nitride (AlN), magnesium oxide ($MgO_2$), silicon oxide ($SiO_2$), silicon carbide (SiC), silicon nitride ($Si_3N_4$), tungsten oxide (WO), and tungsten nitride (WN), and the casting material may include a band having a solid solution structure of aluminum and one or more non-metallic elements selected from oxygen (O), carbon (C), and nitrogen (N) generated by decomposition of the non-metal-containing nanopowder.

In one embodiment, an undecomposed nanopowder in the non-metal-containing nanopowder can be removed from the aluminum alloy molten metal during the third step so that a content of the non-metal-containing nano-powder remaining in the form of powder in the casting material is 0.001 wt % or less.

In one embodiment, the aluminum alloy material may have excellent elongation due to the presence of the band, and through this, cold rolling may be possible.

In one embodiment, the manufacturing method of the aluminum alloy material may further include a fifth step of manufacturing a cold-rolled material by hot rolling and then cold rolling the casting material.

In one embodiment, the casting material can be hot-rolled to manufacture a plate-shaped hot-rolled material, and then cold rolling to 70% to 98% of a thickness of the hot-rolled material can be performed to prepare a cold-rolled material.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
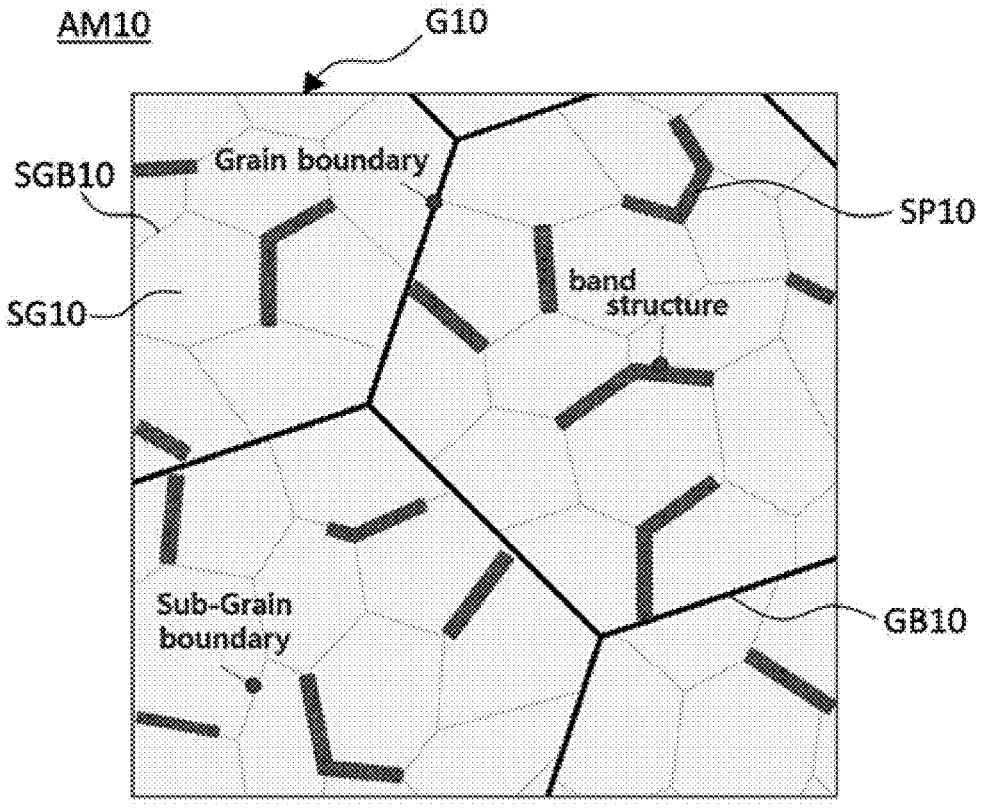
FIG. 1 is a view for describing an aluminum alloy material according to an embodiment of the present invention.

Hereinafter, embodiments of the present invention will be described in detail with reference to the accompanying drawings. While the invention is susceptible to various modifications and forms, specific embodiments are illustrated in the drawings and described in detail herein. However, this is not intended to limit the present invention to specific embodiments, and it should be understood to include all modifications, equivalents and substitutes included in the spirit and scope of the present invention. Like reference numerals are used for like components while describing each drawing. In the accompanying drawings, the dimensions of the structures are shown larger than the actual size for clarity of the present invention.

The terms used in the present application are only used to describe specific embodiments, and are not intended to limit the present invention. Singular expressions include plural expressions unless the context clearly dictates otherwise. In the present application, it is to be understood that the terms "include(s)" or "have(has)" and the like are intended to specify the presence of stated features, numbers, steps, operations, components, or combinations thereof, but do not preclude the presence or addition of one or more other features, numbers, steps, operations, components, and combinations thereof.

Unless defined otherwise, all terms used herein, including technical or scientific terms, have the same meaning as commonly understood by one of ordinary skill in the art to which this invention belongs. Terms such as those defined in a commonly used dictionary should be interpreted as having a meaning consistent with the meaning in the context of the related art, and should not be interpreted in an ideal or excessively formal meaning unless explicitly defined in the present application.

<Aluminum Alloy Material>

FIG. 1 is a schematic diagram for describing an aluminum alloy material according to an embodiment of the present invention. Referring to FIG. 1, the aluminum alloy material according to the present embodiment may include an aluminum alloy matrix AM10 and a band SP10 positioned inside the aluminum alloy matrix AM10.

Figure 5A:
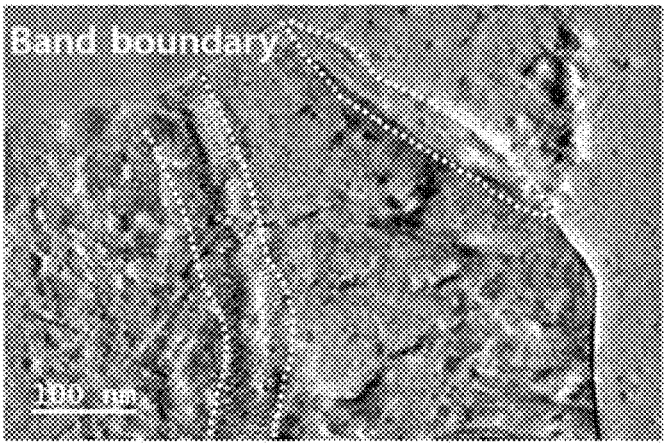
FIG. 5A and 5B are TEM image of a band in an aluminum alloy matrix prepared according to an embodiment of the present invention.
Figure 5B:
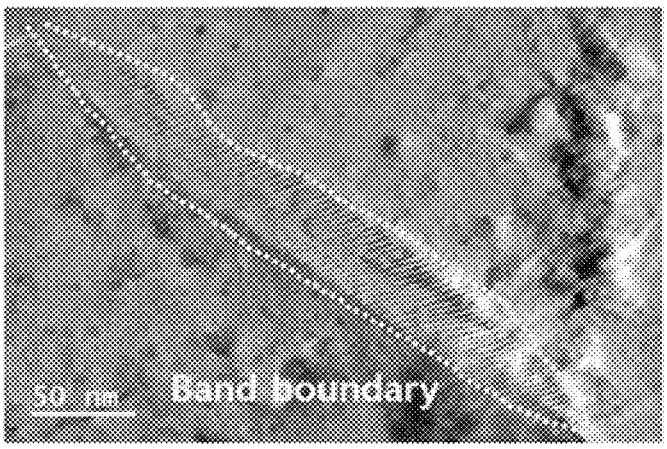

In the present specification, "band" can mean an organization with a band, a rod form, a sheet form, or a form similar to these extending along the surface forming a high-angle and/or low angle grain boundary of the aluminum alloy matrix AM10. The band may have a solid solution structure in which a non-metallic element described later substitutes for some aluminum elements in a crystal structure of pure aluminum elements, or which is interposed between aluminum elements constituting a crystal structure. The crystal structure of the pure aluminum elements may be a face-centered cubic (FCC) structure. Therefore, as can be seen in FIG. 5, the band can be visually confirmed in a TEM image or the like, and can also be confirmed through a non-metallic element forming the solid solution with aluminum. It can be confirmed that the band has a bandwidth of about 5 nm to about 100 nm and a length of about 1 μm to about 10 μm. In addition, the band disposed at the low-angle grain boundary is characterized by forming a substantially coherent interface with at least one of adjacent sub-grains, and a plurality of dislocations spaced apart from each other at a predetermined density may be provided along the coherent interface.

In one embodiment, the alloying element may selectively include one or more selected from the group consisting of zinc, magnesium, silicon, iron, and copper. When zinc is included, a zinc content may be, for example, 0.1 wt % or more and 12.0 wt % or less based on the aluminum alloy matrix, and when magnesium is included, a magnesium content may be 0.1 wt % or more and 9.0 wt % or less. In addition, when silicon is included, the silicon content may be 0.1 wt % or more and 13.0 wt % or less, and when copper is included, the copper content may be 0.1 wt % or more and 5.0 wt % or less, but is not limited thereto.

In one embodiment, the alloying element may include one or more selected from the group consisting of scandium (Sc), yttrium (Y), titanium (Ti), zirconium (Zr), vanadium (V), chromium (Cr), manganese (Mn), iron (Fe), nickel (Ni), copper (Cu), silver (Ag), zinc (Zn), tungsten (W), magnesium (Mg), calcium (Ca), strontium (Sr) and beryllium (Be).

The aluminum alloy matrix AM10 may be formed of an alloy of the alloying element and aluminum (Al), and may have a crystalline structure including a plurality of grains.

In one embodiment, the aluminum alloy matrix AM10 may have a solid solution structure in which in a crystal structure of pure aluminum elements, the alloy element substitutes for some aluminum elements or is interposed between the aluminum elements that form the crystal structure while maintaining the crystal structure. The crystal structure of the pure aluminum elements may be a face-centered cubic (FCC) structure.

In one embodiment, the aluminum alloy matrix AM10 may include a plurality of grains G10 divided by a high-angle grain boundary (HAGB) GB10, and each of the grains G10 may include a plurality of sub-grains SG10 divided by a low-angle grain boundary (LAGB) SGB10.

Crystal orientation directions of two adjacent grains G10 divided by the high-angle grain boundary GB10 may form a mis-orientation angle of about 15° or more, and crystal orientation directions of two adjacent sub-grains SG10 divided by a low-angle grain boundary (LAGB) SGB10 may form a mis-orientation angle of about 15° or less.

In one embodiment, in the case of the band SP10 disposed on the low-angle grain boundary SGB10, a substantially coherent interface may be formed with at least one of adjacent sub-grains SG10. Accordingly, a plurality of dislocations (not shown) spaced apart from each other at a predetermined density may be provided along the coherent interface. Accordingly, when the aluminum alloy material is deformed, the band SP10 can function as a dislocation supply source, and as a result, elongation of the aluminum alloy material can be remarkably improved. In addition, when the aluminum alloy material is deformed, the band SP10 can serve as an obstacle that hinders or inhibits the movement of dislocations, and as a result, the strength of the aluminum alloy material can be improved.

In one embodiment, an average size (width) of each of the grains G10 may be, for example, about 20 to 800 μm, and the average size (width) of each of the sub-grains SG10 divided by the band SP10 may be, for example, on the order of about 100 to 1000 nm. However, the size ranges of the grain G10 and the sub-grain SG10 are exemplary and are not limited thereto.

In one embodiment, the band SP10 may have a solid solution structure of aluminum and one or more non-metallic elements selected from oxygen (O), carbon (C), and nitrogen (N). The band SP10 may have the same or similar crystal structure as that of the aluminum alloy matrix AM10. For example, the band SP10 may have a crystal structure in which the non-metallic element penetrates into a crystal structure formed of pure aluminum, and as a result, a lattice constant of the band SP10 can be greater than the lattice constant of the aluminum alloy matrix AM10. For example, the lattice constant of the band SP10 may be greater than the lattice constant of the aluminum alloy matrix AM10 in a range of about 0.01% to about 10%. For example, the lattice constant of the band SP10 may be about 0.405 nm or more and about 0.42 nm or less.

Meanwhile, in the band SP10, a content of the non-metallic element may be about 0.01 wt % or more and about 10 wt % or less, in this case, the band SP10 may not contain inherent aluminum oxide ($Al_2O_3$), aluminum carbide ($Al_4C_3$, $Al_2C$, $Al_2C_2$), aluminum nitride (AlN), etc.

Meanwhile, when the band SP10 forms part of grain boundaries GB10 and SGB10, a thickness of the band SP10 may be greater than that of other grain boundary regions GB10 and SGB10. For example, the band may have an average width of 5 nm or more and 100 nm or less, or about 20 nm or more and 65 nm or less. The average length of the band may be 1 μm or more and 10 μm or less.

In one example of the present invention, the band includes a pre-formed dislocation, and a dislocation cell size of the band may be reduced during plastic deformation. The band can improve dislocation activity by serving as a source of a new dislocation and a sink of an already generated dislocation, and accordingly, an aluminum alloy material having the band can have remarkably improved elongation. In addition, since a dislocation cell size is very small due to the dislocation activated by the band, overall plastic deformation ability can be improved.

In one embodiment, the aluminum alloy material according to an embodiment of the present invention may be a casting material or a plate-shaped processed material manufactured by processing from the casting material. When the aluminum alloy material is a casting material, even if the casting material is processed through a rolling process, the band SP10 may be maintained inside the processed material. In this case, an average particle diameter of crystal grains of a casting material of the aluminum alloy material may be 20 μm or more and 800 μm or less.

In one embodiment, the aluminum alloy material according to an embodiment of the present invention may be a material prepared by cold rolling a casting. In the case of an aluminum alloy composite material containing conventional ceramic reinforcing particles, processing through a cold rolling process is practically impossible due to low elongation, but the aluminum alloy material according to the present invention has high elongation due to the presence of the above-mentioned band and can be processed through the cold rolling process. In addition, during a rolling process of the aluminum alloy material, the band may be maintained inside a processed material and may be dispersed and disposed inside the aluminum alloy material.

According to the aluminum alloy material of the present invention, since a band having the same or similar crystal structure as the matrix in a polycrystalline aluminum alloy matrix has a structure dispersed in the alloy matrix, the band serves as a dislocation generation source when deformed, and since the band can act as an obstacle to movement of dislocations, the aluminum alloy material can have excellent mechanical properties such as significantly improved elongation and high strength.

Figure 2:
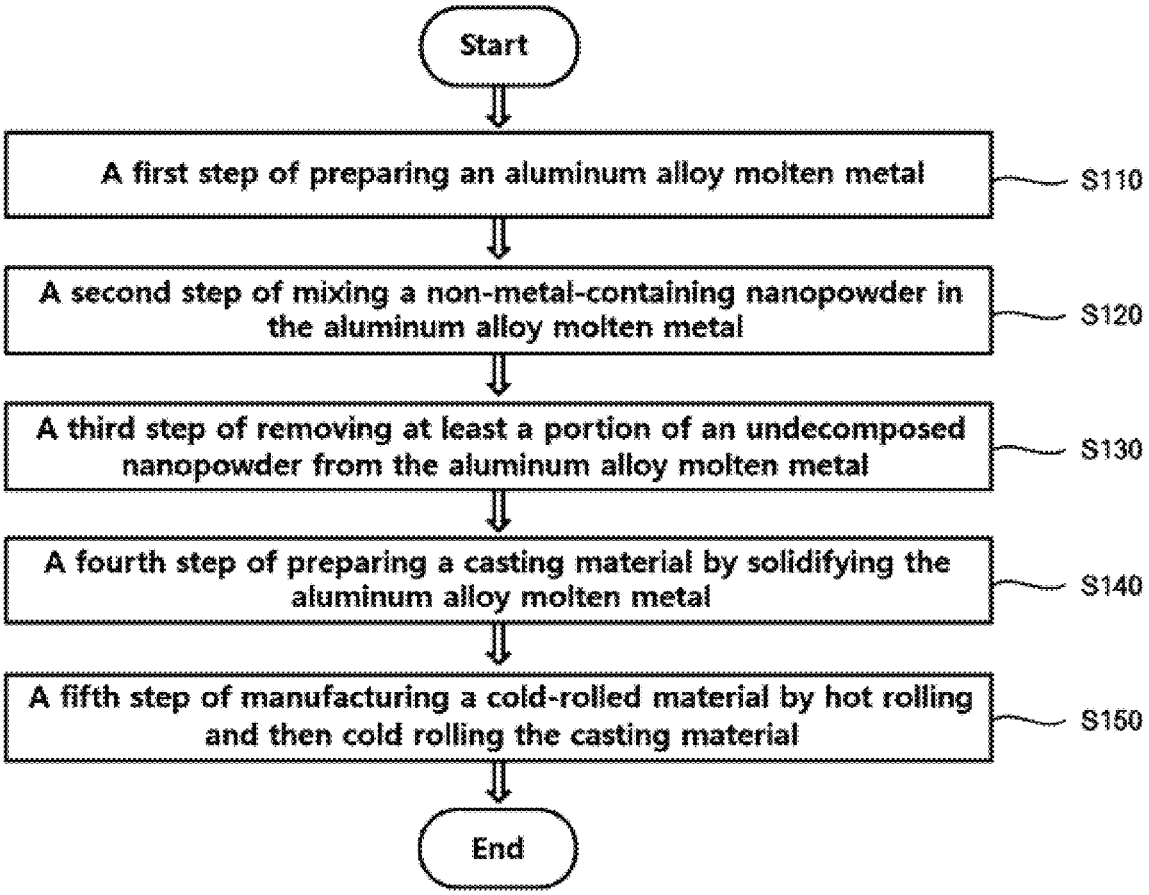
FIG. 2 is a flowchart for describing a method of preparing an aluminum alloy material according to an embodiment of the present invention.
Figure 3:
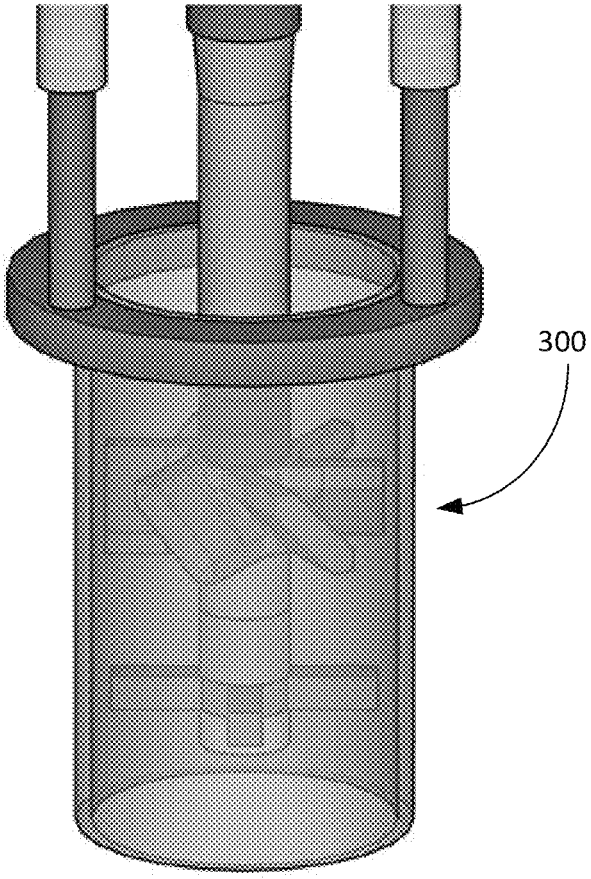
FIG. 3 is a schematic diagram schematically showing a stirring device used in a process of mixing non-metal-containing nanopowder in an aluminum alloy molten metal.

FIG. 2 is a flow chart for describing a method of preparing an aluminum alloy material according to an embodiment of the present invention, and FIG. 3 is a diagram for describing a stirring device 300 used in a process of mixing non-metal-containing nanopowder in an aluminum alloy molten metal.

Referring to FIG. 2, a method of preparing an aluminum alloy material according to an embodiment of the present invention may include a first step of preparing an aluminum alloy molten metal (S110), a second step of mixing a non-metal-containing nanopowder in the aluminum alloy molten metal (S120), a third step of removing at least a portion of an undecomposed nanopowder from the aluminum alloy molten metal (S130), a fourth step of preparing a casting material by solidifying the aluminum alloy molten metal (S140), and a fifth step of preparing a cold-rolled material by hot rolling and then cold rolling the casting material (S150).

In the first step (S110), the aluminum alloy molten metal may be provided by heating the aluminum alloy using an electric melting furnace. A heating temperature of a molten metal may be, for example, about 650° C. to about 1000° C., but is not limited thereto and may vary.

In one embodiment, the aluminum alloy molten metal may include one or more alloying elements selected from the group consisting of scandium (Sc), yttrium (Y), titanium (Ti), zirconium (Zr), vanadium (V), chromium (Cr), manganese (Mn), iron (Fe), nickel (Ni), copper (Cu), silver (Ag), zinc (Zn), tungsten (W), magnesium (Mg), calcium (Ca), strontium (Sr) and beryllium (Be) together with aluminum.

In one embodiment, the aluminum alloy molten metal may selectively include one or more alloying elements selected from the group consisting of zinc, magnesium, silicon, iron, and copper together with aluminum. When zinc is included as the alloying element, a zinc content may be, for example, 0.1 wt % or more and 12.0 wt % or less based on the aluminum alloy matrix, and when magnesium is included, a magnesium content may be 0.1 wt % or more and 9.0 wt % or less. In addition, when silicon is included as the alloying element, the silicon content may be 0.1 wt % or more and 13.0 wt % or less, and when copper is included, the copper content may be 0.1 wt % or more and 5.0 wt % or less, but is not limited thereto.

In the second step (S120), a non-metal-containing nanopowder, which is a precursor of a non-metallic element, may be added into the molten metal. The non-metal-containing nanopowder is added to form the above-described band, and the non-metallic element may be at least one of oxygen (O), carbon (C), and nitrogen (N). The non-metallic-containing nanopowder may be a powder of a compound containing the non-metallic element.

In one embodiment, the non-metal-containing nanopowder may be a ceramic nanopowder. As a specific example, the nanopowder may include at least one of zinc oxide (ZnO), titanium oxide ($TiO_2$), copper oxide ($CuO_2$), iron oxide ($Fe_2O_3$), copper nitride (CuN), iron nitride (FeN), zinc nitride (ZnN), titanium nitride (TiN), and magnesium nitride (MgN). Alternatively, the nanopowder may include at least one of aluminum oxide ($Al_2O_3$), aluminum nitride (AlN), magnesium oxide ($MgO_2$), silicon oxide ($SiO_2$), silicon carbide (SiC), silicon nitride ($Si_3N_4$), tungsten oxide (WO) and tungsten nitride (WN). However, specific material types of the nanopowder are exemplary, and the present invention is not limited thereto.

In one embodiment, the non-metal-containing nanopowder may have an average particle diameter of about 5 nm to about 500 nm. When an average particle diameter of the non-metal-containing nanopowder is greater than 500 nm, the proportion of the non-metal-containing nanopowder decomposed in the molten metal is significantly lowered, causing a problem that an amount of bands generated in the aluminum alloy material is too small.

In one embodiment, the non-metal-containing nanopowder may be added in an amount of about 0.01 wt % to 5.0 wt %, preferably about 0.1 wt % to 4.0 wt %, based on a total weight of the molten metal.

In one embodiment, a method of mixing the non-metal-containing nanopowder into the aluminum alloy molten metal is not particularly limited. For example, the non-metal-containing nanopowder may be mixed with the aluminum alloy molten metal using the stirring device 300 shown in FIG. 3. A device for mixing the non-metal-containing nanopowder into the aluminum alloy molten metal is not particularly limited as long as it has sufficient shear force and heat resistance. The stirring device 300 shown in FIG. 3 has rotary blades disposed in two places, upper and lower parts, but is not limited thereto, and the number of rotary blades and a shape of the rotor may be modified as necessary.

Meanwhile, during the second step (S120), at least a portion of the non-metal-containing nanopowder may be decomposed in the molten metal. Since the size of the non-metal-containing nano-powder is nanoscale, the non-metal nano-powder can be decomposed at a temperature equal to or lower than a melting temperature of the compound constituting the non-metal nano-powder.

In addition, components of the non-metal-containing nanopowder decomposed in the molten metal may move relative to each other in the molten metal by diffusion. As some components of the non-metal-containing nanopowder are decomposed and diffused while being stirred in the molten metal, the non-metal component can be dispersed at a high-angle grain boundary and a low-angle grain boundary, and can be employed in the aluminum matrix.

In the third step (S130), after a predetermined time has elapsed after mixing the non-metal-containing nanopowder into the aluminum alloy molten metal, at least a portion of the undecomposed nanopowder among the non-metal-containing nanopowder may be removed from the aluminum alloy molten metal. When an amount of the non-metal-containing nanopowder remaining inside the casting material prepared in the fourth step (S140) is excessively increased, the strength of the casting material may be improved, but a problem in which the elongation of the casting material is significantly reduced occurs, and as a result, a problem in that the casting material cannot be processed through a cold rolling process may occur. In one embodiment, at least a portion of the undecomposed nanopowder in the non-metal-containing nanopowder can be removed from the aluminum alloy molten metal so that a content of the non-metal-containing nano-powder remaining in the form of powder in the casting material is about 0.001 wt % or less.

In one embodiment, the undecomposed nanopowder may be removed from the aluminum alloy molten metal by a method of gas bubbling filtration. For example, by generating gas bubbles inside the aluminum alloy molten metal, the undecomposed nanopowder may float to the surface of the molten metal, and the floating nanopowder may be removed from the molten metal.

In the fourth step (S140), the casting material may be formed by gradually cooling and solidifying the molten aluminum alloy from which the undecomposed nanopowder is removed.

In one embodiment, in the cooling process for manufacturing the casting material, the aluminum alloy molten metal may be crystallized to form an aluminum alloy matrix, and in the crystallization process of the aluminum alloy molten metal, non-metallic elements such as oxygen (O), carbon (C), or nitrogen (N) generated by decomposition of the non-metal-containing nanopowder are distributed in the aluminum alloy matrix and penetrate into the aluminum alloy crystal to form the band described above.

The casting material prepared as in the first to fourth steps (S110, S120, S130, and S140) has almost no reinforcing phase in a powder form therein, and since the casting material includes the band having the same or similar crystal structure as the aluminum alloy matrix and acting as a dislocation source, it can have very high elongation and excellent strength.

In the fifth step (S150), the casting material may be primarily processed through a hot rolling process and then cold-rolled to manufacture a cold-rolled material.

In one embodiment, after forming a plate-shaped hot-rolled material having a first thickness through the hot-rolling process for the casting material, the cold-rolled material may be prepared by cold rolling to about 70 to 98% of the first thickness, for example, about 80 to 98%. For example, a thickness of the hot-rolled material may be about 5 mm to 30 mm, and a thickness of the cold-rolled material may be about 2 to 20% of the thickness.

As described above, since the aluminum alloy material of the present invention has a structure in which a polycrystalline aluminum alloy matrix and a band identical or similar to the crystal structure of the matrix are distributed, the elongation and strength of the aluminum alloy material are significantly improved, so that even a material in a relatively thick state can be cold-rolled to at about 70% to 98%.

Hereinafter, experimental examples of the present invention will be described in detail. However, the following Examples are merely some embodiments of the present invention, and scope of the present invention is not limited to the following Examples.

Pure aluminum (99.8% pure), zinc (99.9% pure), magnesium (99.8% pure), copper (99.9% pure), silicon (99.9% pure), titanium (Al-10Ti master alloy), chromium (Al-40Cr master alloy) and manganese (Al-20Mn master alloy) ingots, and zinc oxide (ZnO) having an average particle diameter of about 20 nm were used as starting materials.

After melting the pure aluminum placed into a SiC crucible by heating to 760° C., zinc, magnesium, and copper ingots were added and melted to manufacture an aluminum alloy molten metal having a target composition.

In order to form a band in the aluminum alloy, a zinc oxide powder was placed into the prepared aluminum alloy molten metal. Thereafter, the added zinc oxide powder was mixed into the aluminum alloy molten metal by stirring at 400 rpm for 15 minutes using a stirring device.

After the added zinc oxide was sufficiently mixed, impurities and a residual undecomposed zinc oxide powder were removed from the aluminum alloy molten metal. A gas bubbling filtration method was used to remove impurities, and after removing the impurities and the residual powder, solidification was performed to prepare a slab.

In addition, in the case of a comparative example, the same aluminum and alloy elements as in the embodiment were used, except that zinc oxide used as a non-metallic element was not used, and an alloy molten metal was prepared with the same content.

Figure 4A:
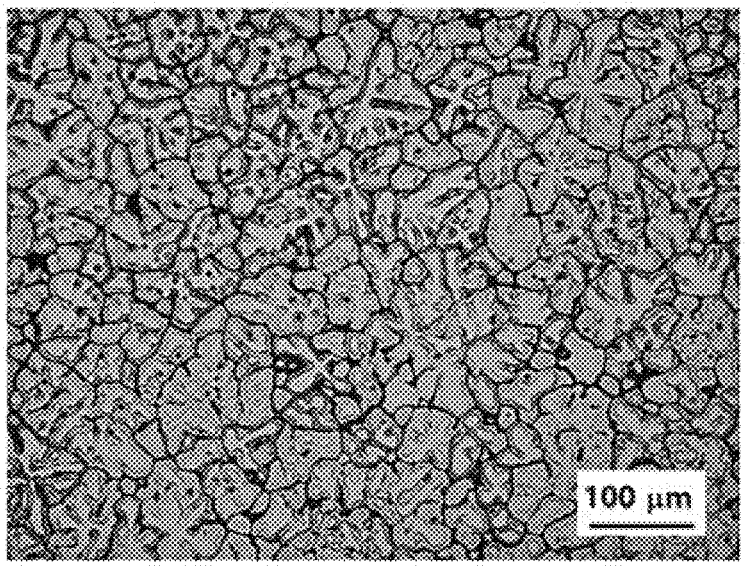
FIG. 4A is an OM image of a 9Zn-2.5Mg-1.5Cu-0.3Ti aluminum alloy casting material prepared according to a comparative example.
Figure 4B:
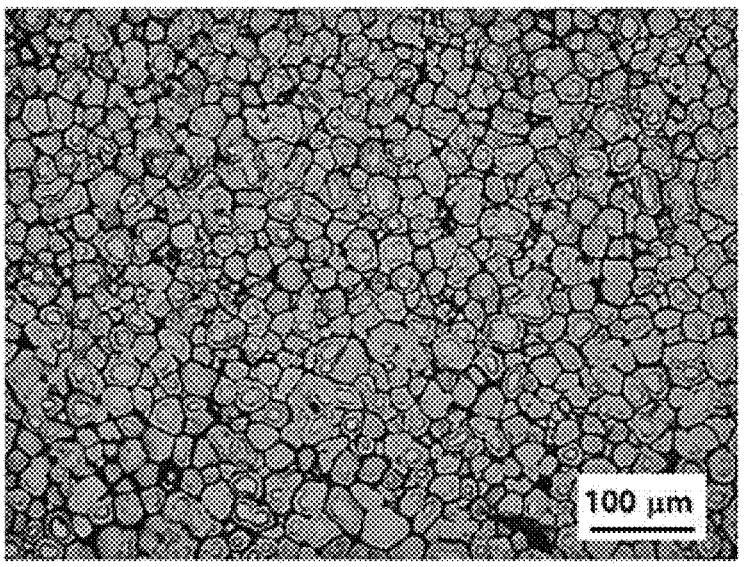
FIG. 4B is an OM image of a 9Zn-2.5Mg-1.5Cu-0.3Ti aluminum alloy casting material prepared according to an embodiment of the present invention.

As one example, when the Al-9Zn-2.5Mg-1.5Cu-0.3Ti aluminum alloy casting material was prepared through the above embodiment, the crystal grains of the casting material were refined to about 20 μm. It can be confirmed that a crystal grain size of the aluminum alloy casting material prepared according to the embodiment of FIG. 4B is much finer than a crystal grain size (about 80 μm) of an aluminum alloy casting material prepared according to the comparative example of FIG. 4A.

An Al-6Zn-2.5Mg-1.5Cu aluminum alloy slab prepared in another embodiment was subjected to homogenization heat treatment at 430° C. for 6 hours, and then oxides on a surface were removed through processing. A prepared sample was hot-rolled to 20 mm at 400° C., and then cold-rolled to 1 mm at a reduction rate of 10 to 20% to prepare a final aluminum alloy material.

FIG. 5 are transmission electron micrographs of aluminum alloy materials prepared according to an embodiment. Referring to FIG. 5, an aluminum alloy material prepared according to the embodiment is composed of sub-grains having a size of about 200 nm to 500 nm, and it can be confirmed that a band is present at a low-angle grain boundary which is the boundary of the sub-grains. In addition, it can be confirmed that the band has a bandwidth of about 5 nm to about 100 nm and a length of about 1 μm to about 10 μm.

Figure 6A:
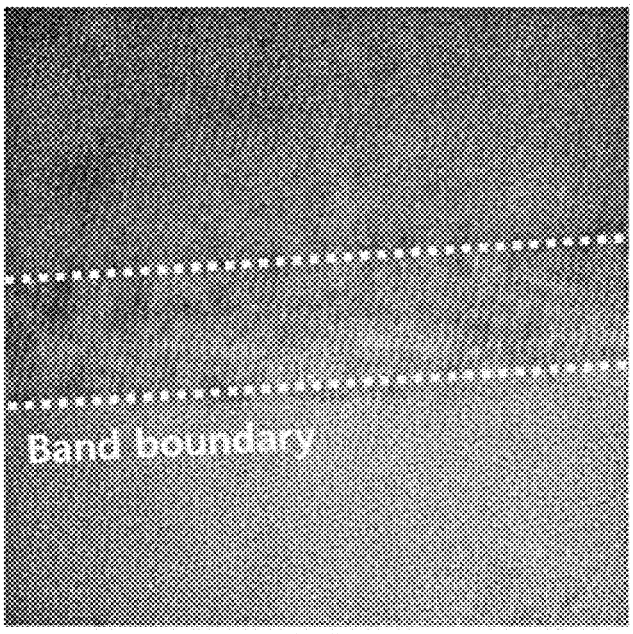
FIG. 6A is an HR-TEM image in which a band of an aluminum alloy material prepared according to an embodiment of the present invention is taken at high magnification.
Figure 6B:
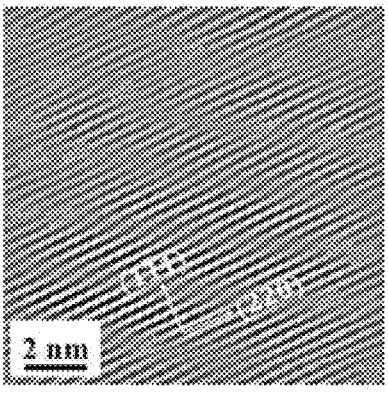
FIGS. 6B, 6C and 6D are inverse fast Fourier transform (IFFT) images taken on the (111), (220), and (131) planes, respectively.
Figure 6C:
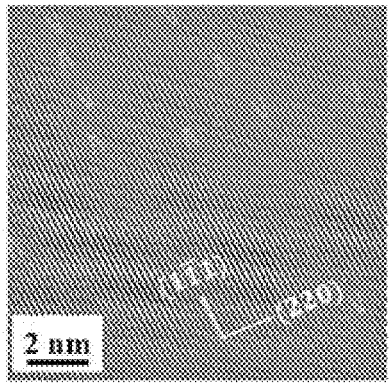
Figure 6D:
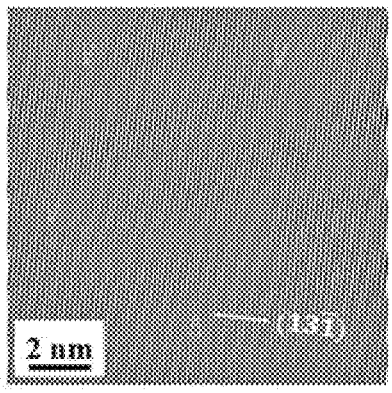

FIG. 6A is an HR-TEM image of the band observed at high magnification, and FIGS. 6B, 6C and 6D are inverse fast Fourier transform (IFFT) images of the bands observed on (111), (220), and (131) planes, respectively. A v-shape in FIGS. 6B to 6D is a dislocation present in an aluminum lattice. Referring to FIG. 6, the band can improve dislocation activity by serving as a source of a new dislocation and a sink of an already generated dislocation, and accordingly, an aluminum alloy material having the band can have remarkably improved elongation. In addition, since a dislocation cell size is very small due to the dislocation activated by the band, overall plastic deformation ability can be improved.

Figure 7A:
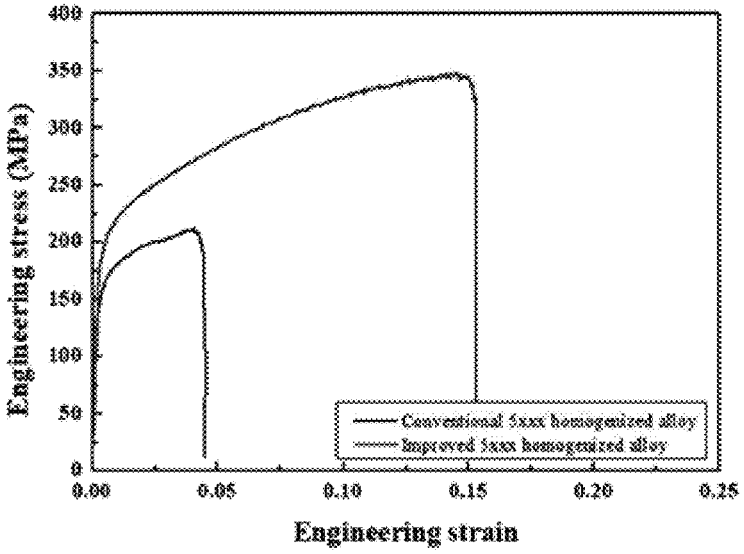
FIG. 7A is a graph showing tensile test results for a 5000 series aluminum alloy casting material prepared according to an embodiment and a 5000 series aluminum alloy casting material prepared according to a comparative example.

FIG. 7A is a graph showing tensile test results for a 5000 series aluminum alloy casting material prepared according to an embodiment and a 5000 series aluminum alloy casting material prepared according to a comparative example. The composition of the 5000 series aluminum alloy casting material prepared according to the embodiment was Al-4.7Mg-4.0Zn-0.1Mn-0.1Cr, and 2.0 wt % of ZnO nanoparticles was added as a non-metal-containing nanopowder. Referring to FIG. 7A, it can be confirmed that the 5000 series aluminum alloy casting material prepared according to the embodiment exhibits elongation that is about 3 times higher than that of the 5000 series aluminum alloy casting material prepared according to the comparative example.

Figure 7B:
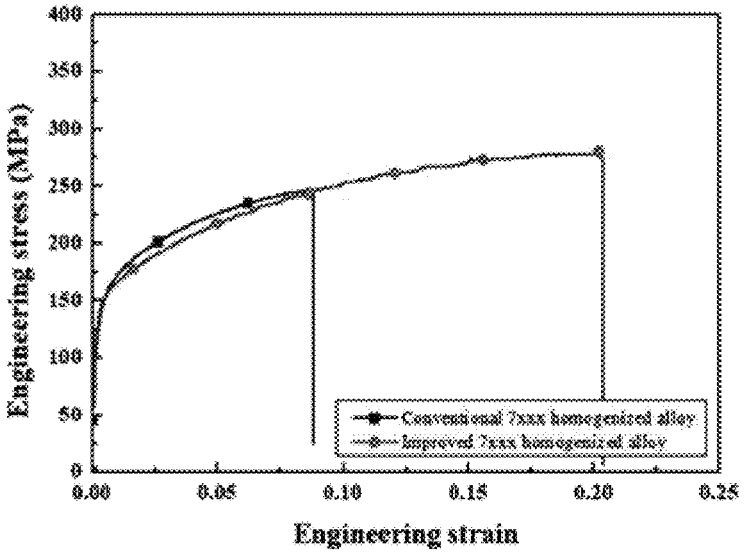
FIG. 7B is a graph showing tensile test results for a 7000 series aluminum alloy casting material prepared according to an embodiment and a 7000 series aluminum alloy casting material prepared according to a comparative example.

FIG. 7B is a graph showing tensile test results for a 7000 series aluminum alloy casting material prepared according to an embodiment and a 7000 series aluminum alloy casting material prepared according to a comparative example. The composition of the 7000 series aluminum alloy casting material prepared according to the embodiment was Al-6Zn-2.5Mg-1.5Cu, and 2.0 wt % of ZnO nanoparticles was added as a non-metal-containing nanopowder. Referring to FIG. 7B, it can be confirmed that the 7000 series aluminum alloy casting material prepared according to the embodiment exhibits elongation that is about twice or more higher than that of the 7000 series aluminum alloy casting material prepared according to the comparative example.

Figure 8:
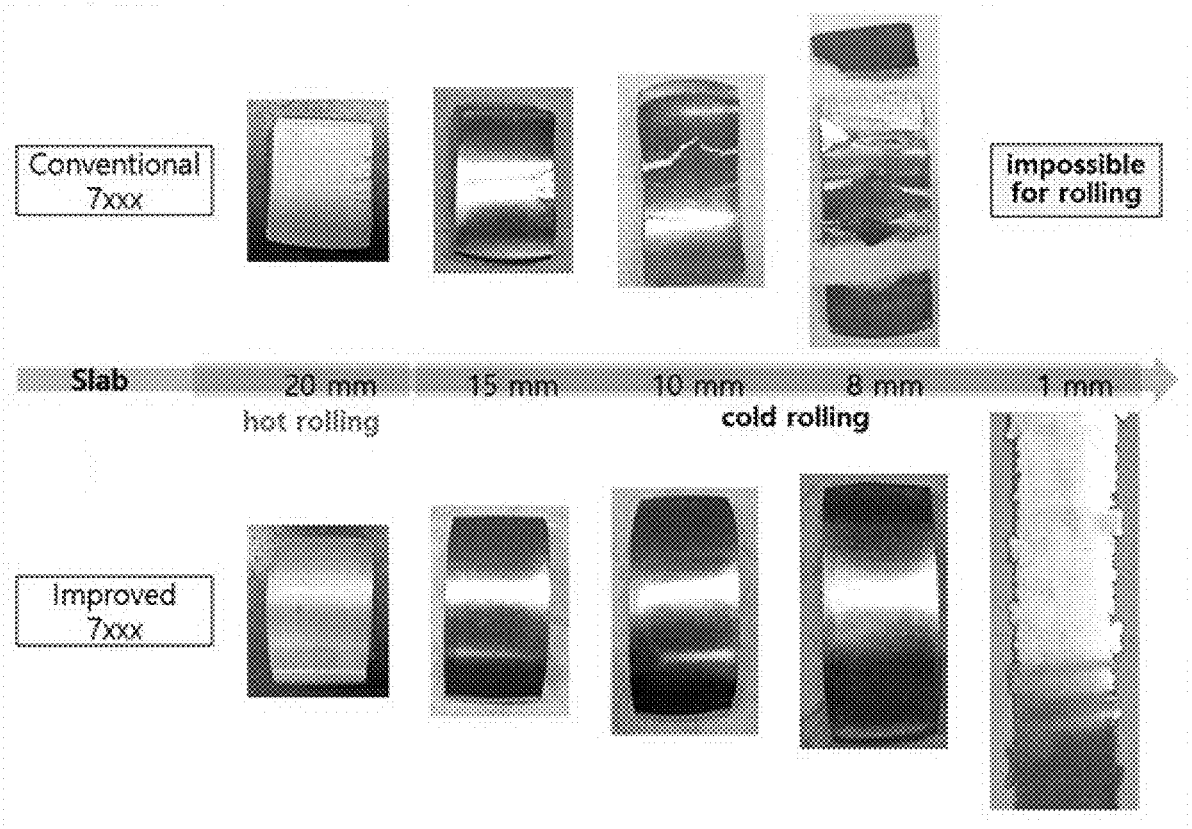
FIG. 8 is a set of sample images in hot rolling and cold rolling processes for a 7000 series aluminum alloy casting material prepared according to the comparative example of FIG. 7B and a 7000 series aluminum alloy casting material prepared according to an embodiment.

FIG. 8 is a set of sample images in hot rolling and cold rolling processes for a 7000 series aluminum alloy casting material prepared according to the comparative example of FIG. 7B and a 7000 series aluminum alloy casting material prepared according to an embodiment Referring to FIG. 8, in the case of the 7000 series aluminum alloy casting material prepared according to the comparative example, side cracks occurred as soon as cold rolling started, and a fracture of a plate material occurred at a thickness of about 8 mm, whereas in the 7000 series aluminum alloy casting material prepared according to the embodiment, a cold-rolled material having a thickness of 1 mm was finally prepared with little occurrence of cracks.

Figure 9A:
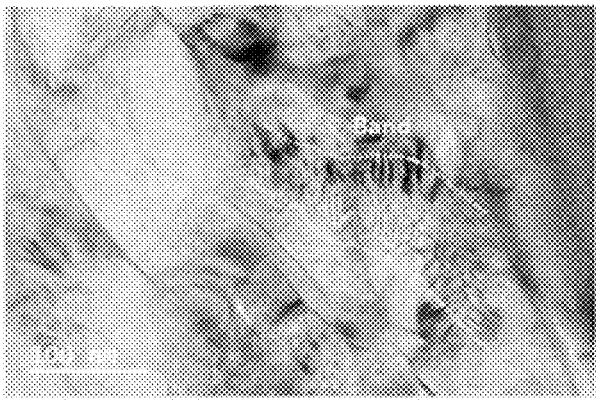
FIG. 9A and 9B are TEM image taken after inter-rolling and recrystallization heat treatment of an aluminum alloy material prepared according to an embodiment of the present invention.
Figure 9B:
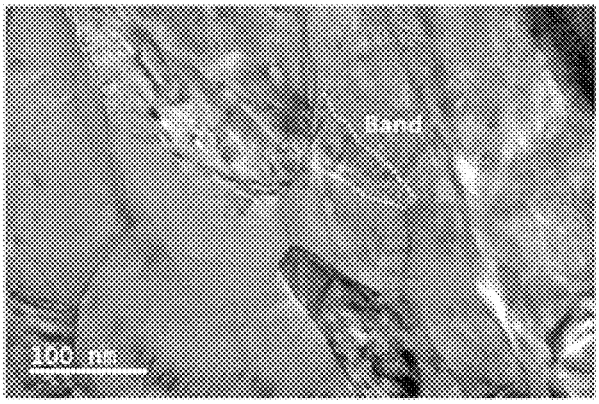

FIGS. 9A and 9B are TEM images taken of microstructures after cold rolling and crystallization heat treatment of an aluminum alloy material prepared according to an embodiment. Referring to FIGS. 9A and 9B, it can be confirmed that a band is present even after passing through hot rolling, cold rolling and a heat treatment process. Through this, it can be confirmed that a band of the aluminum alloy material according to the present invention can play an important role in improving the elongation of a material in the same way as in a casting material.

Figure 10A:
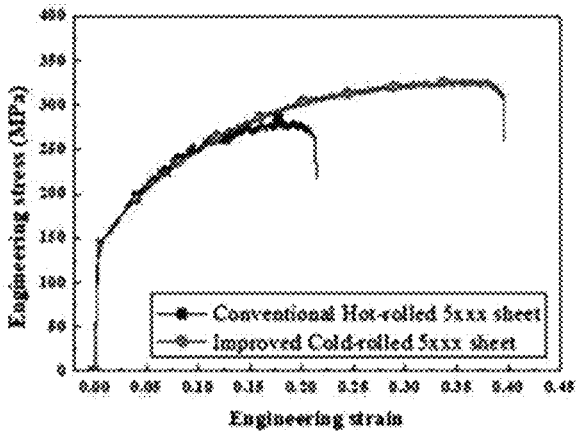
FIGS. 10A, 10B and 10C are a graph showing tensile test results for materials obtained by hot rolling 5000 series, 6000 series and 7000 series aluminum alloy casting materials prepared according to a comparative example, and materials obtained by hot rolling and then cold rolling 5000 series, 6000 series and 7000 series aluminum alloy casting materials prepared according to an embodiment of the present invention, respectively.
Figure 10B:
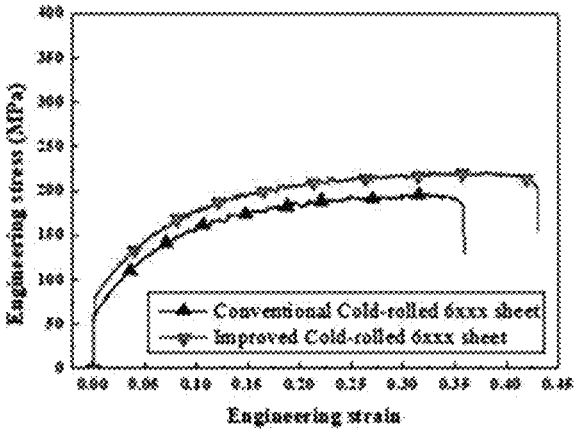
Figure 10C:
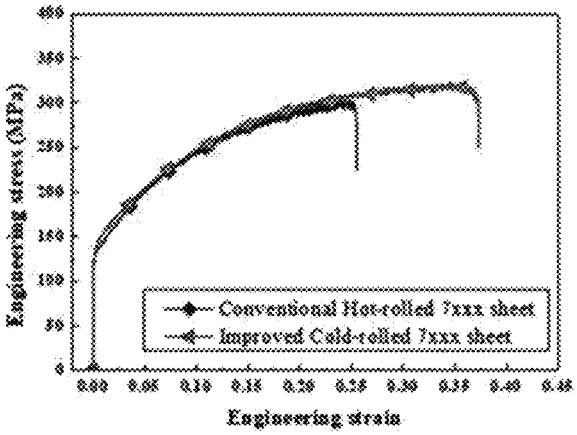

FIGS. 10A, 10B and 10C are graphs showing tensile test results for materials obtained by hot-rolling 5000 series, 6000 series and 7000 series aluminum alloy casting materials prepared according to a comparative example, and materials obtained by hot rolling and then cold rolling 5000 series, 6000 series and 7000 series aluminum alloy casting materials prepared according to an embodiment, respectively. Compositions of 5000 series, 6000 series and 7000 series aluminum alloys prepared according to the embodiment are Al-4.7Mg-4.0Zn-0.1Mn-0.1Cr, Al-1.2Si-0.4Mg-0.3Cu and Al-6Zn-2.5Mg-1.5Cu, respectively.

Referring to FIG. 10, it was found that materials after hot rolling and then cold-rolling 5000 series, 6000 series, and 7000 series aluminum alloy casting materials prepared according to the embodiment had better elongation than those after hot-rolling the 5000 series, 6000 series, and 7000 series aluminum alloy casting materials prepared according to the comparative example, respectively. In particular, cold-rolled 5000 series and 6000 series materials showed excellent elongation close to 40%.

Figure 11A:
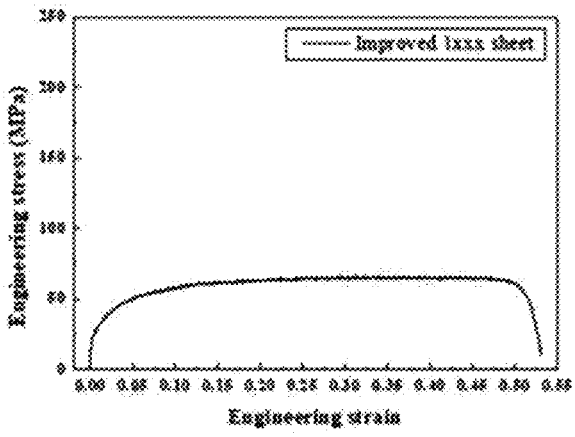
FIGS. 11A and 11B are graphs showing tensile test results of 1000 series and 8000 series aluminum alloy plates prepared according to an embodiment of the present invention, respectively.
Figure 11B:
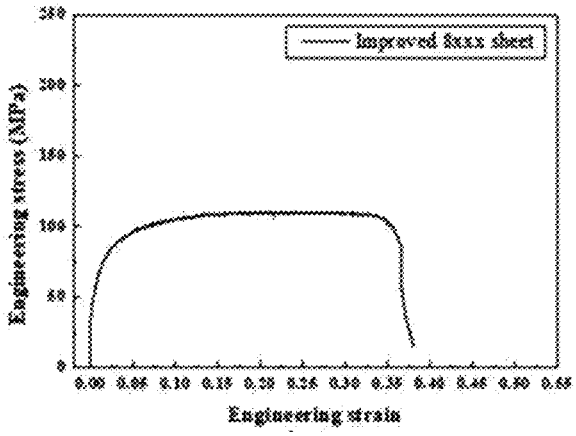
Figure 11C:
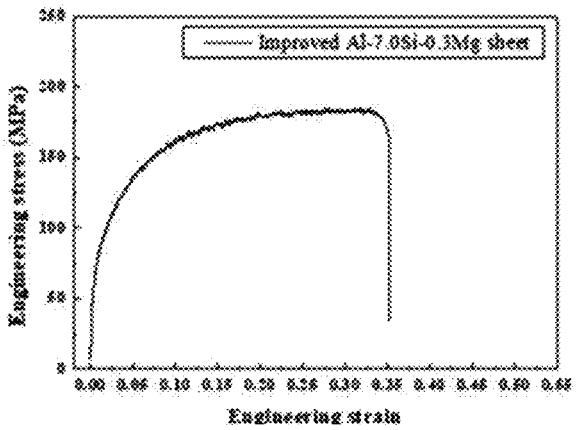
FIG. 11C is a graph showing tensile test results of cold-rolled plates after hot rolling the Al-7.0Si-0.3Mg aluminum alloy casting material prepared according to an embodiment of the present invention.

FIGS. 11A, 11B and 11C are graphs showing the tensile test results for plates prepared by hot-rolling or cold-rolling 1000 series, 8000 series and Al-7.0Si-0.3Mg aluminum alloy casting materials prepared according to an embodiment, respectively. Referring to FIG. 11, it can be confirmed that all of aluminum alloy plates produced according to the embodiment exhibits an excellent elongation of 35% or more.

Figure 12A:
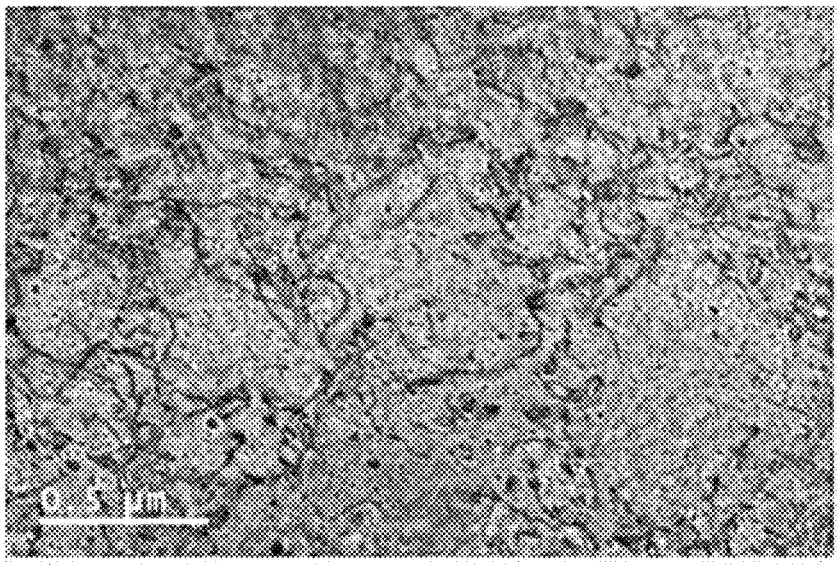
FIG. 12A and 12B are TEM image after deforming an aluminum alloy plate prepared according to an embodiment of the present invention by 5%.
Figure 12B:
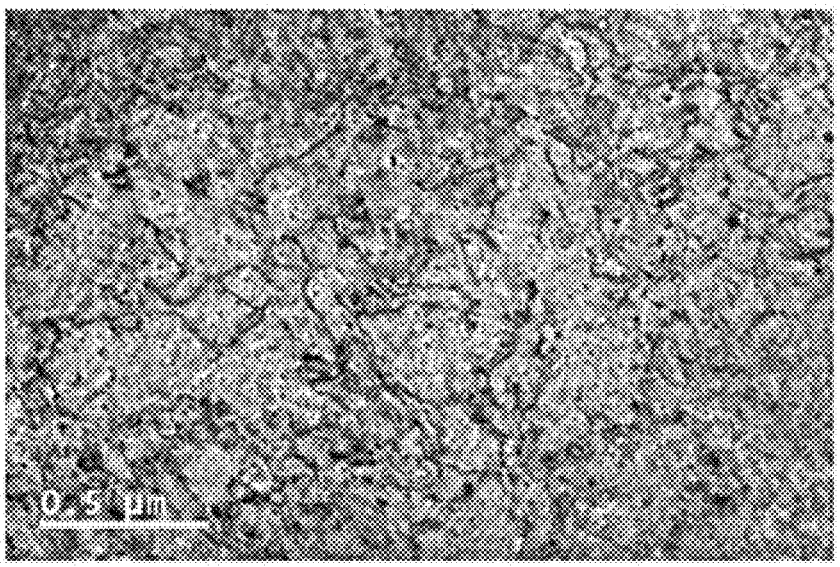

FIG. 12A and 12B are TEM images after subjecting an aluminum alloy material of the present invention prepared by cold rolling according to an embodiment of the present invention to 5% deformation. Referring to FIG. 12, it can be confirmed that an aluminum alloy material according to the present invention has a dislocation cell size of about 500 nm after 5% deformation. The above result shows that the aluminum alloy material has a very small size compared to the dislocation cell size of general aluminum, and considering that a dislocation cell size does not decrease below 1.7 μm even when a lot of deformation in applied in the case of aluminum that has not been specially treated, it is judged to have a very small cell size. This is due to the interaction between bands and dislocations, and it can be interpreted that a much larger amount of dislocations can be activated during the deformation process, and as a result, the band contributed greatly to the improvement of elongation.

Although the above has been described with reference to the preferred embodiments of the present invention, a person having ordinary skill in the art can understand that various modifications and changes of the present invention are possible within the spirit and scope of the invention described in the following patent claims.

According to an aluminum alloy material of the present invention and method of preparing the same, an aluminum alloy material having high elongation and excellent mechanical properties such as strength can be implemented by including an aluminum alloy matrix and a band therein.

What is claimed is:

1. An aluminum alloy material, comprising:

an aluminum alloy matrix formed of an alloy of an alloying element and aluminum, including a high-angle grain boundary (HAGB) and a plurality of grains divided by the high-angle grain boundary, and having a face-centered cubic crystal structure; and a band formed by employing one or more non-metallic elements selected from oxygen (O), carbon (C) and nitrogen (N) in the aluminum alloy matrix.

2. The aluminum alloy material of claim 1, wherein the alloying element includes one or more selected from the group consisting of 0.1 wt % or more and 12.0 wt % or less of zinc, 0.1 wt % or more and 9.0 wt % or less of magnesium, 0.1 wt % or more and 13.0 wt % or less of silicon, and 0.1 wt % or more of 5.0 wt % or less of copper.

3. The aluminum alloy material of claim 1, wherein the alloying element includes one or more selected from the group consisting of scandium (Sc), yttrium (Y), titanium (Ti), zirconium (Zr), vanadium (V), chromium (Cr), manganese (Mn), iron (Fe), nickel (Ni), copper (Cu), silver (Ag), zinc (Zn), tungsten (W), magnesium (Mg), calcium (Ca), strontium (Sr) and beryllium (Be).

4. The aluminum alloy material of claim 1, wherein each of the grains includes a plurality of sub-grains divided by a low-angle grain boundary (LAGB), and a band disposed at the low-angle grain boundary forms a substantially coherent interface with at least one of adjacent sub-grains.

5. The aluminum alloy material of claim 1, wherein the band has an average width of 5 nm or more and 100 nm or less, and an average length of 1 μm or more and 10 μm or less.

6. The aluminum alloy material of claim 1, wherein a lattice constant of the band is 0.01% to 10% greater than the lattice constant of the aluminum alloy matrix.

7. The aluminum alloy material of claim 1, wherein the band includes a pre-formed dislocation, and during plastic deformation, a dislocation cell size of the band is reduced.

8. The aluminum alloy material of claim 1, wherein the aluminum alloy material is a material capable of being cold-rolled.

9. The aluminum alloy material of claim 8, wherein the band is dispersed and disposed inside the aluminum alloy material during a rolling process of the aluminum alloy material.

10. The aluminum alloy material of claim 1, wherein an average particle diameter of crystal grains of a casting material of the aluminum alloy material is 20 μm or more and 800 μm or less.

* * * * *